US010119346B2

(12) United States Patent
Randall et al.

(10) Patent No.: US 10,119,346 B2
(45) **Date of Patent: *Nov. 6, 2018**

(54) TOOL FOR USE ON EXIT SIDE OF BORE AND METHOD OF USE THEREOF

(71) Applicant: American Augers, Inc., West Salem, OH (US)

(72) Inventors: Guy Randall, Wooster, OH (US); Jared E. Bird, Jeromesville, OH (US); Richard Gentry, Wooster, OH (US)

(73) Assignee: American Augers, Inc., West Salem, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/626,324

(22) Filed: Jun. 19, 2017

(65) Prior Publication Data

US 2017/0284163 A1 Oct. 5, 2017

Related U.S. Application Data

(63) Continuation of application No. 14/094,321, filed on Dec. 2, 2013, now Pat. No. 9,702,207.

(60) Provisional application No. 61/732,068, filed on Nov. 30, 2012.

(51) Int. Cl.
*E21B 19/16* (2006.01)

(52) U.S. Cl.
CPC ..... *E21B 19/168* (2013.01); *E21B 19/16* (2013.01); *E21B 19/161* (2013.01); *E21B 19/163* (2013.01); *E21B 19/164* (2013.01)

(58) Field of Classification Search
CPC ..... E21B 19/16; E21B 19/161; E21B 19/168; E21B 19/164
See application file for complete search history.

(56) References Cited

U.S. PATENT DOCUMENTS

| | | | |
|---|---|---|---|
| 5,060,542 | A | 10/1991 | Hauk |
| 6,179,065 | B1 | 1/2001 | Payne et al. |
| 6,334,376 | B1 | 1/2002 | Torres |
| 8,074,537 | B2 | 12/2011 | Hunter |
| 8,109,179 | B2 | 2/2012 | Richardson |
| 8,145,971 | B2 | 4/2012 | LaValley et al. |
| 8,157,495 | B1 | 4/2012 | Randall |
| 8,348,319 | B2 | 1/2013 | LaValley et al. |
| 8,490,519 | B2 | 7/2013 | LaValley et al. |

(Continued)

OTHER PUBLICATIONS

PCT Patent Cooperation Treaty, "PCT International Search Report", dated Mar. 11, 2014, 3 pages, Korean Intellectual Property Office, Republic of Korea.

*Primary Examiner* — Giovanna C. Wright
*Assistant Examiner* — Tara E Schimpf
(74) *Attorney, Agent, or Firm* — Tomlinson McKinstry, P.C

(57) ABSTRACT

A tool for making up and breaking out a drill string at an exit side of a bore. The tool includes a fixed vise and a moveable vise for torqueing a pipe joint, a roller assembly for threading and unthreading adjacent sections of pipe, and a retainer assembly to retain a detached pipe section. The components of the tool are mounted on a frame, which is pivotally connected to a hydraulic machine such as an excavator. Thus, the tool may be manipulated to remove and add sections of pipe to a drill string remote from the primary horizontal directional drill.

15 Claims, 5 Drawing Sheets

(56) References Cited

U.S. PATENT DOCUMENTS

| | | | | |
|---|---|---|---|---|
| 2002/0079105 | A1* | 6/2002 | Bergeron | B23P 19/061 166/379 |
| 2003/0132030 | A1* | 7/2003 | Tompkins | E21B 19/164 175/52 |
| 2009/0057019 | A1 | 3/2009 | LaValley et al. | |
| 2012/0297933 | A1 | 11/2012 | LaValley et al. | |
| 2014/0151124 | A1 | 6/2014 | Randall et al. | |
| 2015/0259993 | A1 | 9/2015 | Patel et al. | |

* cited by examiner

TOOL FOR USE ON EXIT SIDE OF BORE AND METHOD OF USE THEREOF

CROSS REFERENCE TO RELATED APPLICATIONS

This application is a continuation of U.S. patent application Ser. No. 14/094,321 filed Dec. 2, 2013, which claims the benefit of U.S. provisional patent application Ser. No. 61/732,068, filed on Nov. 30, 2012, the entire contents of which are incorporated herein by reference.

FIELD

The present invention relates generally to a tool that may be used in connection with a horizontal directional drilling system, comprised of a plurality of drill pipes that are joined together at pipe joints and to a method for using such a tool. More particularly, the invention comprises a tool that is used to perform various functions on or with respect to the drill pipe sections of the drill string on the exit side of the bore.

BACKGROUND

Many utility lines, pipelines and other underground components are installed in or under the ground by boring a borehole in a generally-horizontal direction in the ground rather than by digging a trench. This type of construction, which is sometimes referred to as "horizontal boring", "directional drilling" or "horizontal directional drilling", reduces the need to dig a trench in order to install an underground component, and thereby saves several steps in the installation process. If no trench is dug, there will be no trench to fill, and no disturbed surface to reclaim. A directional drilling machine may be operated to drill a bore along a planned path underground. Typically, the planned path is generally arcuate in shape from the entry point at the surface of the ground, continuing underneath a roadway, river or other obstacle, to an exit point on the surface on the other side of the obstacle.

A typical directional drilling machine includes a thrust frame that can be aligned at an oblique angle with respect to the ground. Mounted on a drive carriage on the thrust frame is a pipe-rotation mechanism that is adapted to rotate and thrust or retract a series of interconnected pipe sections commonly referred to as a drill string). The drive carriage also includes a carriage drive assembly that is adapted to push the carriage along the thrust frame. The combination of rotation of the drill string and longitudinal movement of the drive carriage along the thrust frame causes the drill string to be advanced into or withdrawn from the ground.

To drill an original or pilot bore using a directional drilling machine, the thrust frame is oriented at an angle relative to the ground, and the drive carriage is retracted to an upper end of the frame. A drill pipe section is coupled to the pipe-rotation mechanism on the drive carriage. A boring tool or cutting head is mounted to the terminal end of the pipe, and the drive carriage is driven in a downward direction along the inclined thrust frame. As the drive carriage is driven downwardly, the pipe-rotation mechanism rotates the pipe about the boring axis, thereby causing the pipe (with boring tool mounted thereon) to be thrust into the ground to drill or bore a hole.

As the drilling operation proceeds, the drill string is lengthened by adding pipe sections to the string. The pipe sections may be provided with a male threaded connector on one end and a female threaded connector on the other end.

Each time a pipe section is added to the drill string, the pipe section being added is aligned with the drill string and the threaded connector on its far end is mated with the threaded connector on the near end of the drill string. Generally, the drill string is restrained against rotation while the pipe being added is rotated to engage the threaded connector on the far end of the pipe section with the threaded connector on the near end of the drill string to create a threaded connection between the components.

Hydraulically actuated wrenches are typically mounted on the horizontal directional drilling rig may be used to hold the drill string as pipe sections are added to lengthen the drill string. These wrenches are also used to separate pipe sections and typically comprise two pairs of opposed jaws, one for the male-threaded pipe and the other for the female-threaded pipe of the adjacent components of the drill string. Each pair of jaws is adapted to clamp around a pipe section, one on the far side and the other on the near side of the threaded connection. At least one pair of jaws of the wrench assembly will pivot with respect to the other pair of jaws to twist one of the pipe sections with respect to the other. However, one skilled in the art will appreciate that connecting the pipe sections may be accomplished using one wrench and the rotating drive of the HDD machine.

When the boring tool reaches a desired depth during the drilling operation, it can be directed along a generally horizontal path and back up to break the surface of the ground at a distant exit point. To control the direction of the borehole, a boring tool with an angled-face or a deflection member may be used. When the direction of the borehole must be changed, the boring tool is positioned with the angled-face or deflection member oriented to cause the tool to move in the desired direction. This ability to change the direction of travel of the drill string also allows the operator to steer the drill string around underground obstacles like large roots and rocks.

When the pilot bore is complete, the boring tool is removed from the second end of the drill string, and the pipe sections are disconnected from each other to disassemble the drill string on the exit side of the bore. In the alternative, the bore may be enlarged by replacing the boring tool with an enlarging device, commonly known as a backreamer. If a backreamer is used, it will be connected to the far or distal end of the drill string in place of the boring tool and moved through the pilot bore back towards the boring machine, either with or without rotation of the drill string. The backreamer expands and stabilizes the walls of the bore, generally while pulling a product pipe or other underground component through the enlarged bore behind it. Movement of the backreamer back towards the drilling machine is accomplished by driving the drive carriage in a rearward direction on the thrust frame to withdraw a pipe section, disconnecting the withdrawn pipe section from the drill string, connecting the next pipe section remaining in the drill string to the pipe rotation mechanism on the drive carriage and repeating the process until all of the pipe sections have been withdrawn from the ground. Each pipe section in the drill string may be uncoupled from the drill string using the same wrench assembly that was used to connect the drill pipes when the pilot bore was drilled. The disconnected pipe section is placed in a stack or loaded into a pipe section magazine of the directional drilling machine.

There are several operations that must be performed on the exit side of the bore where the drill string emerges from the ground. For example, the boring tool may be disconnected from the end of the drill string and the pipe sections of the drill string may be disconnected one by one from the drill string. If a backreamer is used, it may be installed in place of the boring tool. High torque is typically used in order to loosen the boring tool or a pipe section for removal from the drill string or to install the backreamer on the drill string. Most commonly, the drill crew will use a pair of large wrenches such as pipe wrenches or oil field tongs to remove the boring tool and each pipe section, or to install a backreamer. Frequently, the drill crew will connect the handle of the wrench to the bucket of a hydraulic excavator using a chain or strap, and then use the excavator to apply a vertical force to the bucket while the drilling rig operator rotates the drill string to loosen the boring tool or a pipe section or to tighten the backreamer on the end of the drill string. If the drill string is to be disassembled on the exit side, the individual pipe sections may be placed in a stack or in a pipe section magazine. These pipe sections are heavy and long, and it is labor-intensive to disconnect them manually on the exit side of the drill site.

SUMMARY

One embodiment of the invention is directed to an apparatus for boring using a drill string. The drill string comprises a first end, a second end, and a middle portion wherein the middle portion is below a surface of the ground. The apparatus comprises a horizontal directional drilling machine, and a pipe handler comprising a vise assembly, and a first and a second retainer assembly. The horizontal directional drilling machine is located at the first end of the drill string. The vise assembly is to apply a twisting force to the second end of the drill string. The first and second retainer assembly are each located on a first side of the vise assembly to hold a pipe section.

In another embodiment, the invention is directed to a method of drilling a hole having an entry side and an exit side. The method comprises boring a hole with a horizontal directional drilling machine, advancing a drill string comprised of a plurality of pipe sections from the entry side of the hole to the exit side of the hole, placing a tool comprising a vise assembly, a roller assembly, and a retainer assembly proximate the exit side of the hole, adjusting the tool such that a pair of adjacent pipe sections of the drill string are within the vise assembly of the tool, separating the pair of adjacent pipe sections with the vise assembly, unthreading one of the pair of adjacent pipe sections from the drill string through operation of the roller assembly, and retaining the unthreaded pipe section in the retainer assembly.

DETAILED DESCRIPTION

Figure 1:
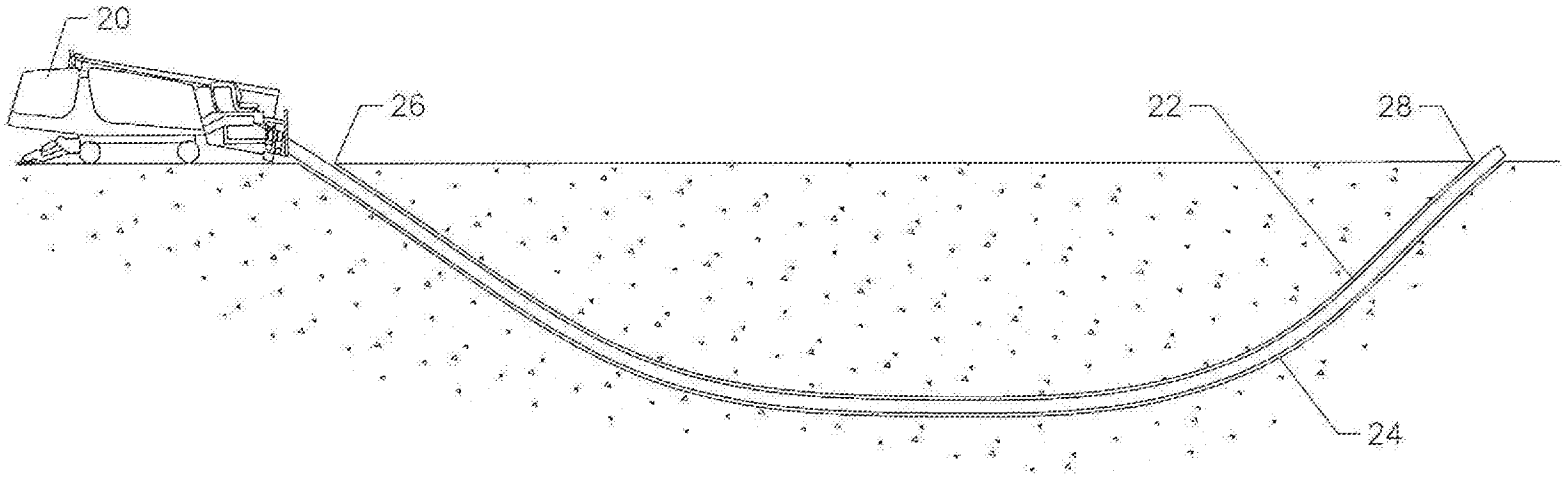
FIG. 1 is a side view of a horizontal directional drilling machine and a drill string having a portion beyond the exit side of a bore.

Referring now to the drawings, FIG. 1 illustrates the use of horizontal drilling machine 20 to thrust and rotate a drill string 22 to drill a bore 24 from an entry point 26 to an exit point 28, The following figures illustrate the use of a tool for use at the exit point 28 to disconnect pipe sections from the drill string 22. The horizontal drilling machine 20 may be utilized with a one-pipe or two-pipe drill string.

Figure 2:
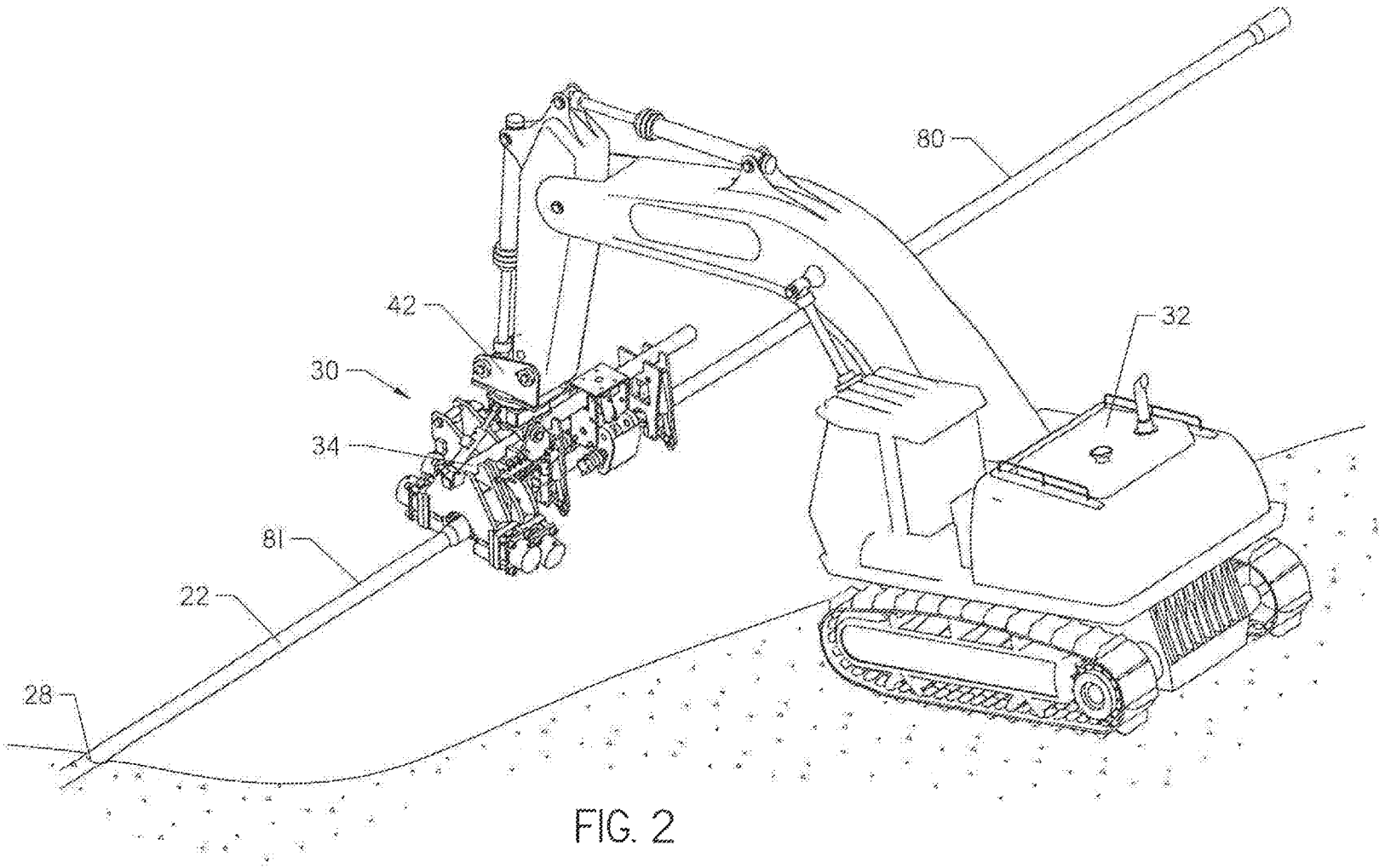
FIG. 2 is a perspective view of a machine supporting a tool for making up and breaking out a drill string at the exit side of a bore.

With reference now to FIG. 2, shown therein is an embodiment of a pipe handler, or tool 30 that may be employed at the exit point 28 of the bore to perform various functions on or with respect to the drill string 22. As shown, a hydraulic machine 32 is provided to support the tool 30. For purposes of illustration, the hydraulic machine 32 of FIG. 2 is a tracked excavator. One skilled in the art will anticipate that many hydraulic machines may be adapted to provide operative force to the tool 30.

The tool 30 comprises a frame 34. The frame 34 is connected to the hydraulic machine 32 by an attachment assembly 42 which will be described in greater detail with reference to FIG. 3 below. The attachment assembly 42 provides a pivotal connection such that the tool 30 may be properly oriented to the drill string 22 for make up or breakout of pipe sections 80 to or from adjacent pipe sections 8*i*.

Figure 3:
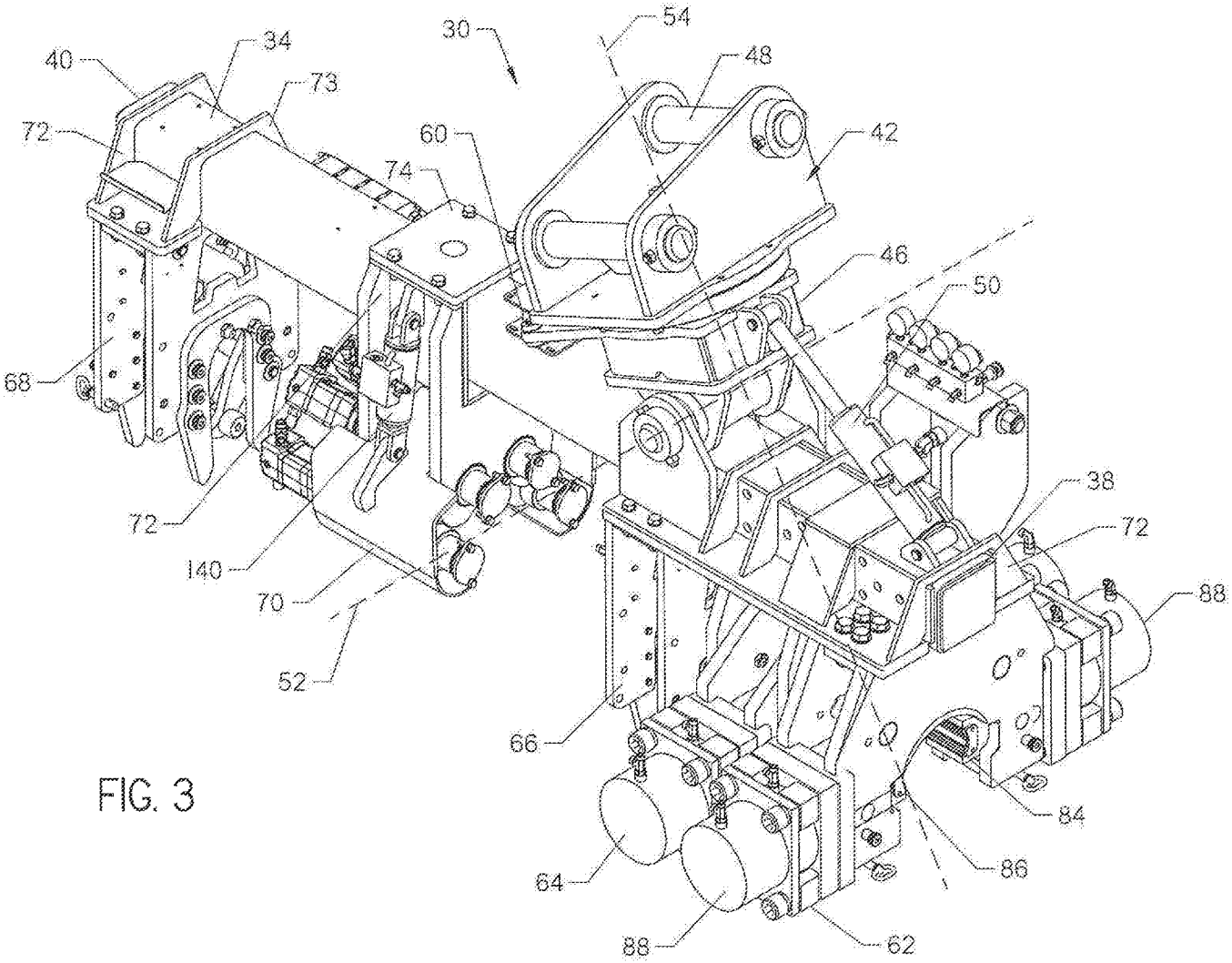
FIG. 3 is a side perspective view of the tool of FIG. 2.

With reference now to FIG. 3, the tool 30 is shown in greater detail. The frame 34 comprises a tubular frame component. The frame 34 comprises a first end 38 and a second end 40. The attachment assembly 42 comprises a base 46 pivotally mounted to the frame, and an attachment bracket 48. The frame 34 is pivoted about a substantially horizontal axis 52 by a cylinder 50 disposed between the base 46 and the frame. The attachment bracket 48 serves as a mechanical connection to the machine 32 (FIG. 2). The frame 34 pivots about a second axis 54 relative to the attachment bracket 48 due to operation of a cylinder 60 extending between the base 46 and the attachment bracket 48. The frame 34 is manipulated by cylinders 50, 60 such that it is substantially parallel with a section of pipe 80 (FIG. 2) to be removed.

With continued reference to FIG. 3, the frame 34 supports and provides attachment for multiple components of the tool 30. The tool 30 comprises a first vise assembly 62, a second vise assembly 64, a first retainer assembly 66, a second retainer assembly 68, and a roller assembly 70. These assemblies work in concert to make up, or connect, and break out, or loosen, sections of pipe in accordance with the invention. The first vise assembly 62 grips the pipe string 22 (FIG. at an adjacent pipe section 81 (FIG. 2) and second vise assembly 64 grips the pipe section to be removed 80 (FIG. 2), with a pipe joint between the first vise assembly and second vise assembly. The first retainer assembly 66 and second retainer assembly 68 retain the section of pipe to be removed. The roller assembly 70 applies a rotational force to the section of drill pipe to be removed after the pipe joint has been loosened by the first and second vise assemblies 62, 64.

Bracket assemblies 72 provide attachment between the components 62, 64, 66, 68, 70 of the tool and the frame 34. In one embodiment, the roller assembly 70 and retainer assemblies 66, 68 may be detachable, or movable along the frame 34. As shown, the bracket assemblies 72 have multiple configurations relative to the frame 34. The bracket assemblies 72 may be welded to a bottom side of the frame 34, or may include a top portion 73 that extends over the top of the frame 34. Further, a cap 74 may be bolted on top of the bracket assembly 72.

The first vise assembly 62 and second vise assembly 64 each comprise a first jaw 84 and second jaw 86. First jaw 84 and second jaw 86 are mounted so as to be moveable with respect to each other between an open position and a closed position in which the jaws may grip a pipe section. An actuator 88 is mounted on the first jaw 84 and adapted to move the first jaw between the open position and the closed position. Similarly, an actuator 88 is mounted on the second jaw 86 and adapted to move the second jaw between the open position and the closed position. The actuator 88 may comprise a hydraulic motor or other suitable actuator. Thus, first jaw 84 and second jaw 86 of the first vise assembly 62 will cooperate to grip a pipe section when in the closed position.

Figure 4:
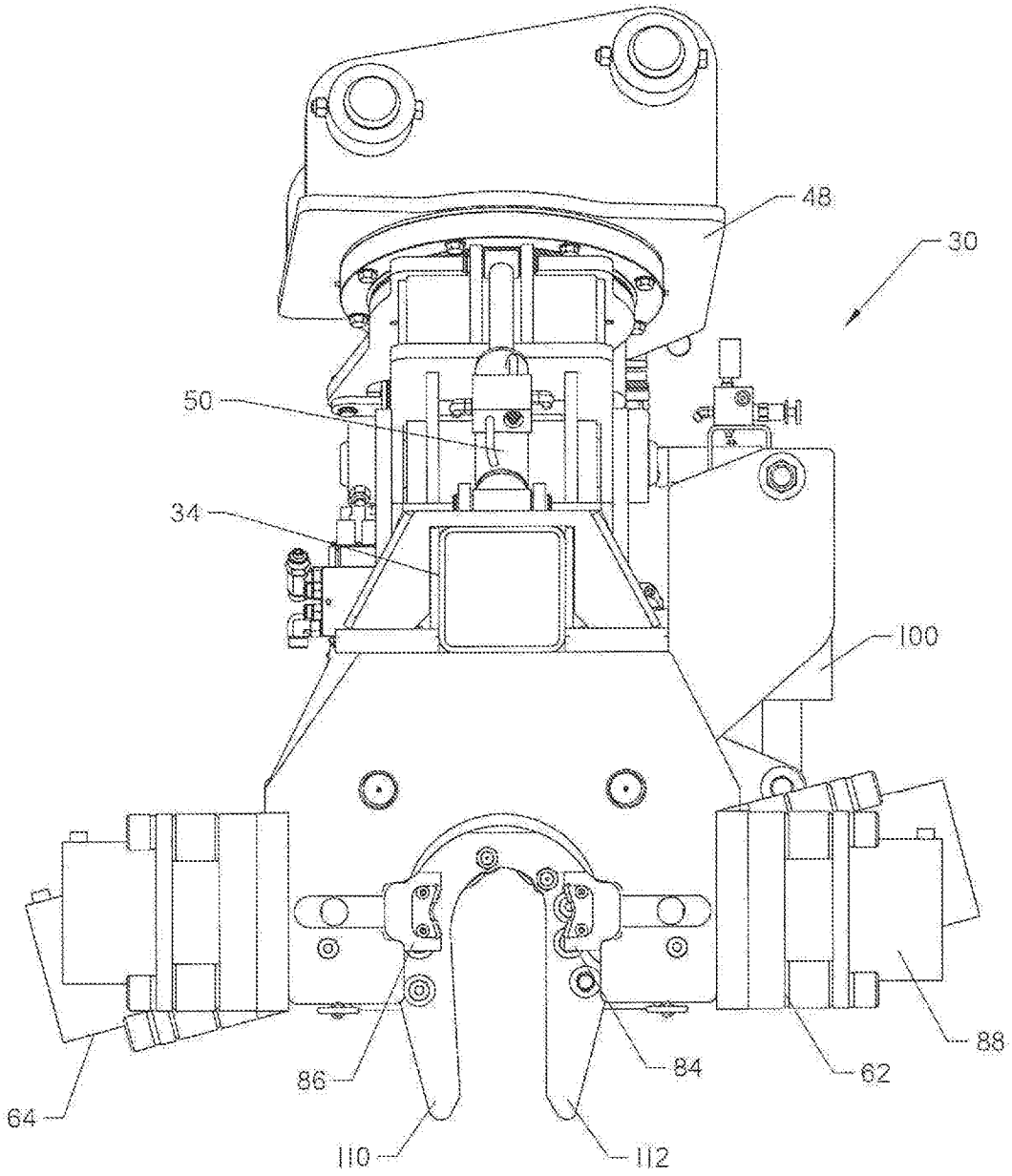
FIG. 4 is an end view of the tool of FIG. 3.

With reference now to FIG. 4, the first vise assembly 62 is fixed and the second vise assembly 64 is moveable with respect to the first vise assembly to apply a twisting force to a pipe section with respect to an adjacent pipe section that is gripped by the first vise assembly. The tool 30 comprises a linear actuator 100 for moving the second vise assembly 64 relative to the first vise assembly 62. The linear actuator 100 may be a hydraulic cylinder. Extension and retraction of the of the linear actuator 100 when the first vise assembly 62 is in the closed position will rotate the pipe section 80 relative to an adjacent section 81 causing the pipe joint formed between these sections to loosen (FIG. 2).

The first vise assembly 62 is shown offset from second vise assembly 64. One of ordinary skill in the art will appreciate that second vise assembly 64 may alternatively be fixed and first vise assembly 62 may be moveable with respect thereto. Furthermore, in another embodiment of the invention, both vise assemblies 62, 64 may be moveable with respect to each other to apply a twisting force to the drill string 22 (FIG. 1). Further, the vise assemblies 62, 64 are preferably movable relative to the drill string 22 through operation of the cylinder 50 to pivot frame 34 relative to the attachment bracket 48.

Figure 5:
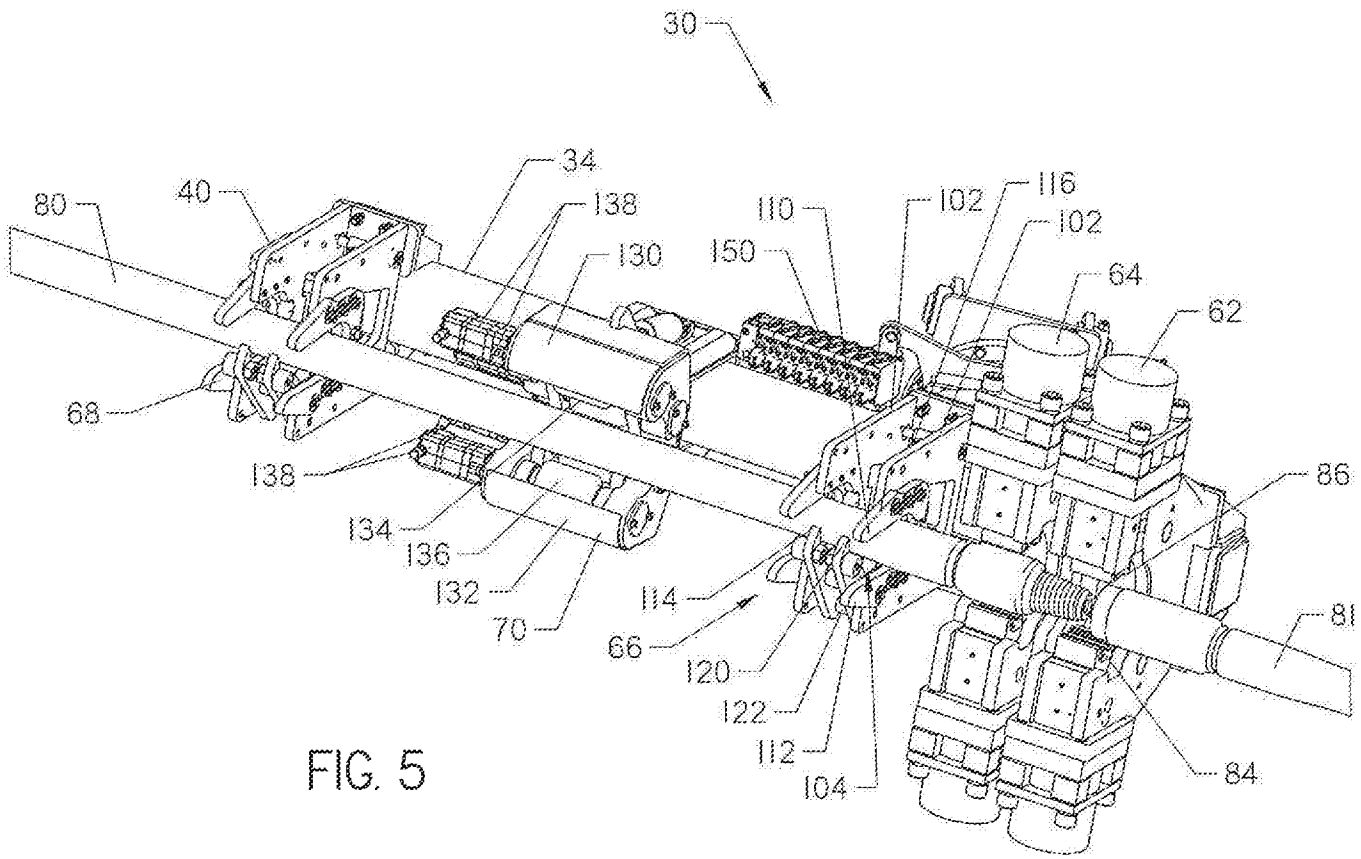
FIG. 5 is a bottom perspective view of the tool of FIG. 2 having a drill string within the tool.

With reference now to FIG. 5, the first retainer assembly 66 is shown. The first retainer assembly 66 comprises at least one bracket frame 102 comprising a pipe receiver opening 104 and a pair of downwardly depending legs 110 and 112 that may be angled outwardly as they extend from the pipe receiver opening. As shown, the first retainer assembly 66 comprises two bracket frames 102. The first retainer assembly 66 further comprises a first retainer arm 114 that is pivotally attached to the bracket frame 102 and adapted to be moved between an open position that will allow a drill pipe section to be received in pipe receiver opening 104 and a closed position (as shown) that retains the pipe section 80 in the opening. As shown, the first retainer arm 114 includes two components that move parallel to one another. The first retainer arm 114 is controlled by a first retainer actuator 116. As shown, the first retainer actuator 116 is a hydraulic cylinder. The first retainer assembly 66 may also comprise a second retainer arm 120. The second retainer arm 120 is likewise pivotally attached to the bracket frame 102 and is adapted to be moved between an open position and a closed position. A second actuator 122 likewise moves the second retainer arm 120 between the open position and the closed position.

As shown, the second retainer assembly 68 is shown with identical components as the first retainer assembly 66, spaced apart from the first retainer assembly to provide two retaining locations for the pipe section 80. One of ordinary skill in the art will appreciate that the first 66 and second 68 retainer assemblies may be given different locations along the frame 34. As shown, the second retainer assembly 68 is proximate the second end 40 of the frame. Further, it is anticipated that the functions of the tool 30 may be performed with only one retainer assembly.

The roller assembly 70 comprises means for rotating a pipe section 80 that is received in the first retainer assembly 66 and in the second retainer assembly 68 about a long axis of the pipe section. The roller assembly 70 may be used to rotate a drill pipe section to engage the threads or disengage the threads of the threaded connectors of drill pipe section 81. In the embodiments shown herein, limited radial extent of the twisting force that second vise assembly 64 would require that second vise assembly grip, twist and release the pipe section 80 multiple times to disconnect it from the drill string. The roller assembly 70 is provided to overcome this limitation. The roller assembly 70 comprises first roller jaw 130 comprising a first roller 134 and second roller jaw 132 comprising a second roller 136. Each of first roller jaw 130 and second roller jaw 132 is pivotally mounted with respect to the frame. Preferably, each roller jaw 130, 132 comprises a plurality of rollers that are rotationally driven. The roller assembly 70 further comprises a motor 138 to rotate each of the rollers 134, 136. As shown in FIG. 5, a motor 138 is utilized proximate each roller jaw 130, 132 to rotate the rollers 134, 136. The motors 138 may rotate the first and second rollers 134, 136 so as to impart a spin to the pipe section, thereby disengaging pipe section 80. A first roller linear actuator 140 (FIG. 3) pivots first roller jaw 130 with respect to the frame 34. A second roller linear actuator (not shown) may be provided to pivot the second roller jaw 132 with respect to the frame 34. It is also possible that roller assembly 70 may be operated to impart a tightening spin to a pipe section or other component on the exit side of the bore by rotating the first and second rollers in the opposite direction to that which is used to disengage the pipe section 80.

With continued reference to FIG. 5, the tool 30 further comprises a control valve assembly 150 that is connected to the auxiliary hydraulic circuit (not shown) of a hydraulic machine such as hydraulic machine 32 (FIG. 2), that may be used to control the various pipe gripping and torque requirements for the operation of the first and second vise assemblies 62, 64, the first and second retainer assemblies 66, 68, and the roller assembly 70. Preferably, a pressure reducer is provided to keep control valve assembly 150 from receiving hydraulic fluid at a pressure higher than about 3000 psi from the hydraulic machine 32 (FIG. 2).

Control valve assembly 150 may include a radio control receiver that is operatively connected to the hydraulic actuators 88, 116, 122, 140 of the tool 30 and the cylinders 50, 60 (FIG. 3). The radio control receiver is adapted to communicate with a remote controller (not shown) for remote operation of the tool 30.

While the majority of this description describes using the tool 30 for the purpose of removing, or breaking out, sections of pipe from the drill string 22, one of ordinary skill could envision the opposite purpose. For example, after a drill bit (not shown) used for primary boring operations is removed from the exit point 28 of the bore 24 and removed from the drill string 22, a backreamer or other tool can be provided to the drill string. This is accomplished by "making up" the drill string 22 using the tool 30. As shown in FIG. 5, a pipe section 80 to be added may be held in the retainer assemblies 66, 68. The roller assembly 70 may provide twisting force to cause the pipe section 80 to be threaded to the pipe string 22 at the adjacent pipe section 81. The connection is then completed through by gripping the adjacent pipe section 81 with the first vise 62, while using the second vise 64 to provide a twisting force to torque the connection.

Although this description contains many specifics, these should not be construed as limiting the scope of the invention, but as merely providing illustrations of some of the presently preferred embodiments thereof.

The invention claimed is:

1. An apparatus for boring using a drill string, the drill string comprising a first end, a second end, and a middle portion wherein the middle portion is below a surface of the ground, the system comprising:

a horizontal directional drilling machine located at the first end of the drill string; and a pipe handler disposed at the second end of the drill string and suspended from an arm comprising:

a frame made of a unitary piece and pivotally attached to the arm;

a vise assembly supported on the frame to apply a twisting force to the second end of the drill string;

a first retainer assembly supported by the frame; and a second retainer assembly supported by the frame and substantially identical to the first retainer assembly and longitudinally separated from the first retainer assembly on the frame along an axis parallel to the drill string;

wherein each of the first retainer assembly and the second retainer assembly are located on a first side of the vise assembly to hold a pipe section.

2. The apparatus of claim 1 further comprising a roller assembly supported by the frame to twist the second end of the drill string.

3. The apparatus of claim 1 further comprising an attachment assembly disposed between the frame and a hydraulic machine, wherein the arm is attached to the hydraulic machine.

4. The apparatus of claim 3 wherein the hydraulic machine provides at least part of the operative force for the pipe handler.

5. The apparatus of claim 1 wherein the vise assembly comprises:

a first vise; and a second vise;

wherein the first vise is fixed and the second vise is moveable relative to the first vise.

6. The apparatus of claim 5 wherein the second vise is disposed between the first vise and the first retainer assembly.

7. The apparatus of claim 1 further comprising a roller assembly supported by the frame between the first and second retainer assemblies to rotate a pipe section located at a second end of the drill string.

8. An apparatus for making up and breaking out a pipe joint on the exit side of a bore and attachable to a hydraulic machine comprising an arm, said apparatus comprising:

a unitary frame comprising a first end and a second end and pivotable relative to the arm and suspended from the arm;

a first vise assembly and a second vise assembly supported on the first end of the frame, each adapted to grip a first and a second pipe section on opposing sides of a pipe joint distal from an entry side of the bore;

wherein the second vise assembly is moveable with respect to the first vise assembly; and a first retainer assembly supported on the frame between the first vise assembly and the second end of the frame and adapted to hold the first pipe section; and a second retainer assembly identical to the first retainer assembly supported on the frame between the first vise assembly and the first retainer assembly.

9. The apparatus of claim 8 wherein the frame is linear and pivotable about a vertical axis and a horizontal axis.

10. The apparatus of claim 9 further wherein the hydraulic machine provides power to the apparatus.

11. The apparatus of claim 8 further comprising a plurality of rollers supported by the frame to provide a twisting force to the first pipe section.

12. The apparatus of claim 11 wherein the first retainer assembly further comprises a first leg and a second leg, and wherein the plurality of rollers are longitudinally separated from the first retainer assembly and the second retainer assembly.

13. The apparatus of claim 11 wherein at least some of the plurality of rollers are pivotally connected to the frame.

14. A method of drilling a hole having an entry side and an exit side comprising:

boring a hole with a horizontal directional drilling machine;

advancing a drill string comprised of a plurality of pipe sections from the entry side of the hole to the exit side of the hole;

suspending the apparatus of claim 8 from a hydraulic machine at the exit side of the hole; and pivoting the apparatus such that a pair of adjacent pipe sections of the drill string are within the vise assembly of the tool.

15. A system comprising:

a horizontal directional drill for rotating and advancing a drill string from an entry side of a bore to an exit side of a bore; and the apparatus of claim 8.

* * * * *